US006683578B2

(12) United States Patent
Nishikido et al.

(10) Patent No.: US 6,683,578 B2
(45) Date of Patent: Jan. 27, 2004

(54) BUILT-IN ANTENNA OF PORTABLE RADIO APPARATUS

(75) Inventors: Tomoaki Nishikido, Komatsu (JP); Yutaka Saito, Nomi-gun (JP); Hiroshi Haruki, Yokohama (JP); Kouta Aoki, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/239,927

(22) PCT Filed: Jan. 10, 2002

(86) PCT No.: PCT/JP02/00096

§ 371 (c)(1),
(2), (4) Date: Sep. 26, 2002

(87) PCT Pub. No.: WO02/056415

PCT Pub. Date: Jul. 18, 2002

(65) Prior Publication Data

US 2003/0058177 A1 Mar. 27, 2003

(30) Foreign Application Priority Data

Jan. 16, 2001 (JP) ..... 2001-8008

(51) Int. Cl.[7] ..... H01Q 1/24
(52) U.S. Cl. ..... 343/702; 343/700 MS
(58) Field of Search ..... 343/702, 700 MS, 343/725; 455/90

(56) References Cited

U.S. PATENT DOCUMENTS

| | | | | |
|---|---|---|---|---|
| 5,204,687 A | | 4/1993 | Elliott et al. | 343/702 |
| 6,252,554 B1 | * | 6/2001 | Isohatala et al. | 343/700 MS |
| 6,326,921 B1 | * | 12/2001 | Egorov et al. | 343/700 MS |
| 6,326,924 B1 | * | 12/2001 | Muramoto et al. | 343/702 |

FOREIGN PATENT DOCUMENTS

| | | | |
|---|---|---|---|
| JP | 57-103406 | 6/1982 | H01Q/13/18 |
| JP | 60-244103 | 12/1985 | H01Q/21/00 |
| JP | 1-272303 | 10/1989 | H01Q/9/38 |
| JP | 5-7106 | 1/1993 | H01Q/1/22 |
| JP | 11-214914 | 8/1999 | H01Q/1/50 |
| JP | 2001-352212 | 12/2001 | H01Q/9/30 |
| JP | 2002-64324 | 2/2002 | H01Q/9/30 |

OTHER PUBLICATIONS

"Nikkei Communication", published by Nikkei Business Publications, Inc., Sep. 2000, pp. 112–116. (cited on p. 7 of specification).

* cited by examiner

*Primary Examiner*—Hoang V. Nguyen
(74) *Attorney, Agent, or Firm*—Pearne & Gordon LLP

(57) ABSTRACT

An object of the invention is that a user obtains high antenna gain with a simple construction in various use conditions of a portable wireless unit. To achieve the above object, in the invention, of a conductive antenna element, a part of a length of a substantially half-wavelength is used as a monopole part (1), and is disposed along the inside of a housing at the upper end of a portable wireless unit. Of the antenna element, the remaining part of a length of a substantially ¼ wavelength is used for an inverted-F antenna part (2), and disposed parallel to a ground plate surface within the housing of the portable wireless unit. The inverted-F antenna part (2) is disposed parallel to the upper end of the portable wireless unit (6). One end of the inverted-F antenna part (2) is connected to the ground plate (5) through an earthing point (3) provided at one end. A feeding point (4) is provided spaced from the earthing point by a predetermined distance. With such an arrangement, there is no need of using an impedance matching circuit. The construction of the portable wireless unit is simplified. High antenna gain is secured under various use conditions.

5 Claims, 11 Drawing Sheets

FIG.1A
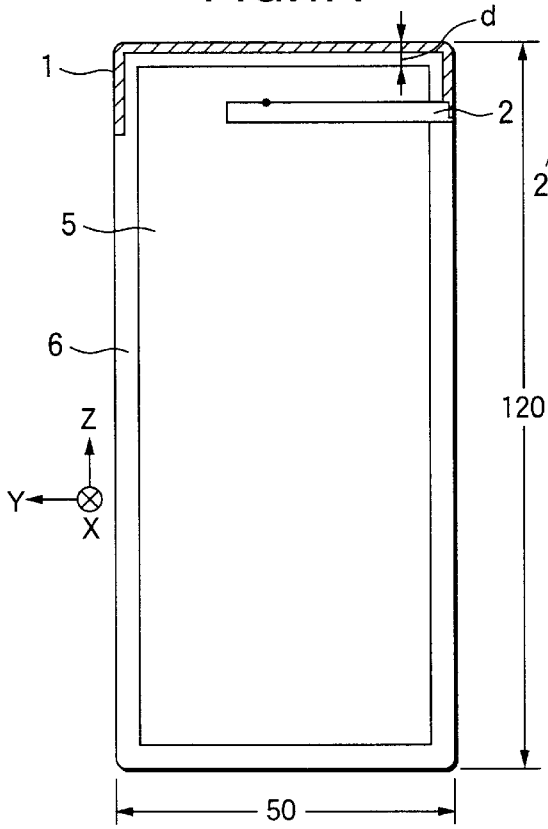
FIG.1C
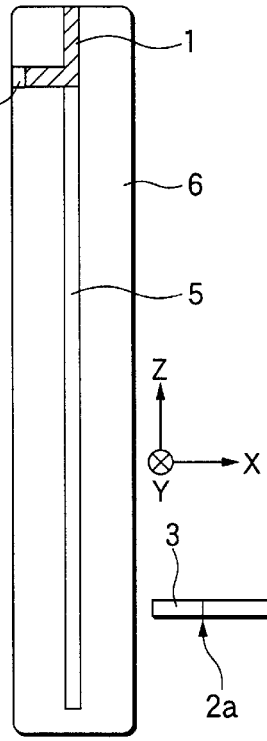
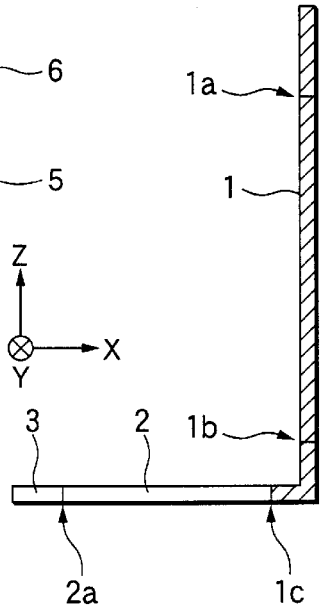
FIG.1D
FIG.1B
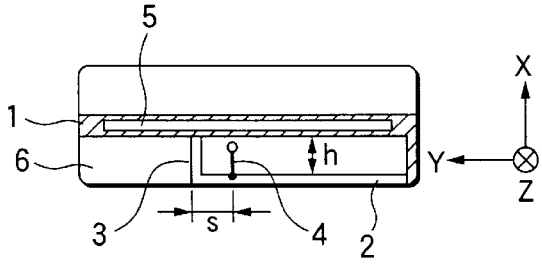

BUILT-IN ANTENNA OF PORTABLE RADIO APPARATUS

TECHNICAL FIELD

The present invention relates to a built-in antenna for a portable wireless unit, which exhibits high radiation characteristics even under various use conditions of the wireless unit.

BACKGROUND ART

In the specification, the term "portable wireless unit" involves a wireless information terminal, such as a music distribution dedicated terminal not having the speech function, in addition to a portable telephone set and PHS (trade mark).

By convention, the portable wireless unit, e.g., portable telephone set or PHS, uses a whip antenna of the telescopic type or a planar inverted-F antenna for its antenna.

The antenna described in the specification of U.S. Pat. No. 5,204,687 may be enumerated for the whip antenna of the telescopic type, used for the portable telephone set. The telescopic type whip antenna is constructed such that an electrically insulated helical antenna is mounted on the tip of the monopole antenna. When it is extended, it serves as a monopole antenna, and when it is contracted and put within the housing of the portable telephone set, it functions as a helical antenna.

The planar inverted-F antenna is disclosed in Japanese Unexamined Patent Laid-Open No. 103406/1981. In the example described in this publication, the planar inverted-F antenna is expanded to have a planar structure, and the peripheral length of the planar element is the half wavelength, and small. When the planar inverted-F antenna is disposed at an end of a ground plate of the housing of the portable telephone set, the planar inverted-F antenna has a relatively broad band characteristic. Further, the planar inverted-F antenna has a structure, which presents an impedance matching function. Therefore, it is advantageous in that there is no need of providing an impedance matching circuit outside the housing.

A normal portable telephone set, as shown in FIG. 12, includes both of a whip antenna attached to the outside of the portable telephone set and a planar inverted-F antenna mounted in the housing. The signals received by those antennae are switched from one to the other and vice versa in a diversity manner. Exactly, the signals received by those antennae are compared in level, and the antenna of which the signal level is the higher of those signal levels is selected, and a communication is performed.

In the portable telephone set shown in FIG. 12, a monopole antenna 27 and a planar inverted-F antenna 30 operate independently, and those antennae do not operate as a called composite antenna. A radio frequency switch 33 selects the monopole antenna 27 or the planar inverted-F antenna 30 depending on the received signal levels, as mentioned above.

An impedance matching circuit 34 matches a feeding point impedance of the monopole antenna 27 to 50 Ω. The planar inverted-F antenna 30 is a conductive plate of which the peripheral length is set to be about the half wavelength of the operating frequency. It is arranged in parallel with a ground plate 26, while being spaced by 4 mm, for example. A feeding point 32 is provided at a point which is on one side of the planar inverted-F antenna 30 and spaced from a earthing portion 31 by a fixed distance, e.g., 3 mm. A radio frequency signal derived from the impedance matching circuit 34 of the monopole antenna 27 or a radio frequency signal derived from the feeding point 32 of the planar inverted-F antenna 30 is selected by the radio frequency switch 33. In FIG. 12, a helical antenna 28 is connected through an insulating portion 29 to the tip of the monopole antenna 27.

Directivity patterns of the antennae of FIG. 12 are depicted in FIGS. 13 and 14 by using the coordinates illustrated aside in FIG. 12. FIG. 13 shows a directivity pattern of the monopole antenna 27 when it is selected, and FIG. 14 shows a directivity pattern of the planar inverted-F antenna 30 when it is selected. In FIG. 13, a solid line 35 indicates a vertically polarized wave component, and a broken line 36 indicates a horizontally polarized wave component. In FIG. 14, a solid line 37 indicates a vertically polarized wave component of the received radio wave, and a broken line 38 indicates a horizontally polarized wave component.

In the monopole antenna 27 shown in FIG. 13, an average level of the vertically polarized wave component 35 is higher than that of the horizontally polarized wave component 36. The vertically polarized wave component 35 has a pattern resembling that of the directivity of an 8-shaped half wavelength dipole. In the planar inverted-F antenna 30 shown in FIG. 14, the horizontally polarized wave component 38 is relatively high, and the vertically polarized wave component 37 has a butterfly-shaped pattern directivity since the antenna current is distributed in the ground plate 26.

A horizontal plane pattern average gain (referred to as PAG) is generally used for an evaluation index used for evaluating the antenna character of the portable telephone set. In a state that a human body equipped with a portable telephone antenna is positioned at the center of a spherical coordinate system, and the head of a human body is directed in the zenithal direction (Z direction), the PAG is given by $$PAG = \frac{1}{2\pi}\int_0^{2\pi}\left[G\theta\left(\frac{\pi}{2}, \phi\right) + \frac{1}{XPR}G\phi\left(\frac{\pi}{2}, \phi\right)\right]d\phi \qquad \text{[Formula 1]}$$

In the above equation, Gθ (ϕ) and Gϕ (ϕ) are power directivities of a vertically polarized wave and a horizontally polarized wave in the X-Y plane.

A general cross-polarization power ratio XPR of a mobile communication unit in a multiple wave environment is expressed by a ratio of the vertically polarized wave component to the horizontally polarized wave component, and is 4 to 9 dB, as known. This ratio is calculated on the assumption that the vertically polarized wave component of an arriving wave is higher than the horizontally polarized wave component by 4 to 9 dB. Accordingly, in the radiation pattern of the antenna, the vertically polarized wave component is weighted by XPR. Substantially in the specification, description of the XPR will be given by using 9 dB as a general value in an urban area. Thus, in the antenna of the portable telephone set, a high PAG is obtained by increasing the vertically polarized wave component when it is in use.

The PAG is generally −7 dB when the portable telephone set is in a speech communication state and the whip antenna is extended, and this value is a target value of the performance of the main antenna contained.

Recently, it is demanded to completely build the main antenna into the portable telephone set, in place of the antenna being protruded outside, such as the whip antenna. In this case, the performance comparable with that of the external whip antenna is required for the built-in main antenna, as a matter of course.

In the conventional built-in type planar inverted-F antenna, however, in the speech communication state that the user grips the portable telephone set and moves it close to his ear, reduction of the radiation efficiency of the antenna is great since the distribution of the antenna current is present in the ground plate of the portable telephone set. For this reason, the PAG of the antenna is lower than that of the whip antenna being extended, approximately −11 dB. It is confirmed that when the portable telephone set is put close to a metal table, the antenna gain reduces, and the value of the PAG is lowered to about −16 dB.

When the portable telephone set is placed on the metal table, the conventional whip antenna is frequently stored in the housing. In this case, the helical antenna 28 shown in FIG. 12 operates. The helical antenna 28 is close to the metal table, and its axial direction is parallel to the metal disk, and its gain is reduced through its electromagnetic interaction with the metal, and the PAG is about −18 dB.

One of the main use conditions of the portable telephone set is that the user grips the portable telephone set, and moves it close to his ear, and talks with another party while slanting it at about 60°. In the PHS telephone set, the moving image distribution together with voice speech, and the video telephone service have started. (Reference is made to the magazine "Nikkei Communication" published by Nikkei Business Publications, Inc, issued Sep. 18, 2000, pp 113 to 115.)

Further, the music delivery service has started by using the wireless information terminal having no communication function. In using each of those devices, the user operates the device in a state that it is positioned near his ear as in the normal voice speech. In an additional case, he grips the device and holds it in front of his chest pocket, and in this state, he operates the device. In a further case, he puts the device in his chest pocket and in this state he operates the device.

In a case where the portable telephone set is put in the chest pocket, the orientation of the telephone set is not fixed. If the planar inverted-F antenna is mounted on one of the sides of the portable telephone set, there is the possibility that the antenna is directed to the human body. In this case, the reduction of the radiation efficiency is great, and the PAG is about −10 dB, and low.

Accordingly, an object of the present invention is to provide an antenna built in the a portable wireless unit which retains a high radiation efficiency in various use conditions, and is simplified at the manufacturing stage.

DISCLOSURE OF THE INVENTION (1) To achieve the above object, there is provided a built-in antenna for a portable wireless unit including a conductive antenna element disposed along the inside of a housing at an upper end of a portable wireless unit, the conductive antenna having a monopole part defined as a part of a length of a substantially half-wavelength of the conductive antenna; an inverted-F antenna part defined as the remaining part of a length of a substantially ¼ wavelength of the conductive antenna; and an antenna feeding point provided at a position near an earthing part of the inverted-F antenna part; wherein the inverted-F antenna part is disposed parallel to a ground plate surface within the housing of the portable wireless unit and parallel to the upper end of the portable wireless unit and one end of the inverted-F antenna part is connected to the ground plate as the earthing part.

With such an arrangement, the antenna may be built in the portable wireless unit with a simple construction which does not requiring the impedance matching circuit. The antenna gain when the portable wireless unit is in speech communication state or placed on a metal table, is improved.

(2) In the built-in antenna for a portable wireless unit, the inverted-F antenna part is disposed along the long side of the portable wireless unit.

With this feature, a high antenna gain is improved in the hand-holding operation state and speech communication state, and in a state that the portable wireless unit is placed on the metal table.

(3) There is another aspect of the invention, there is provided a built-in antenna for a portable wireless including a conductive antenna element disposed along the long side of the inside of a housing, the conductive antenna element having a monopole part defined as a part of a length of a substantially half-wavelength of the conductive antenna element; an inverted-F antenna part defined as the remaining part of a length of a substantially ¼ wavelength of the conductive antenna element; and an antenna feeding point provided at a position near an earthing part; wherein one end of the inverted-F antenna part is connected, to the ground plate as an earthing part, and the inverted-F antenna part is disposed parallel to the ground plate of the housing of the portable wireless unit and along the long side of the inside of the housing.

With this feature, a high antenna gain is improved in the in-chest-pocket state, the hand-holding operation state and speech communication state, and in a state that the portable wireless unit is placed on the metal table.

(4) In the built-in antenna for a portable wireless unit, the inverted-F antenna part is disposed parallel to the ground plate of the housing of the portable wireless unit, and parallel to the upper end of the inside of the housing.

With this feature, a high antenna gain is improved in a state that the portable wireless unit is, at will, put in a chest pocket, the hand-holding operation state and speech communication state, and in a state that the portable wireless unit is placed on the metal table.

(5) The built-in antenna for a portable wireless unit further includes fixing means for fixing the antenna element to the rear side of the housing, and contacting means for making the earthing part and the feeding point of the antenna element contact with a printing pattern on a circuit board.

This feature simplifies the manufacturing process of manufacturing the built-in antenna, leading to the productivity improvement.

BRIEF DESCRIPTION OF THE DRAWINGS

FIGS. 1A, 1B, 1C, and 1D are diagrams showing a basic construction of a built-in antenna which is a first embodiment of the present invention.

Figure 2:
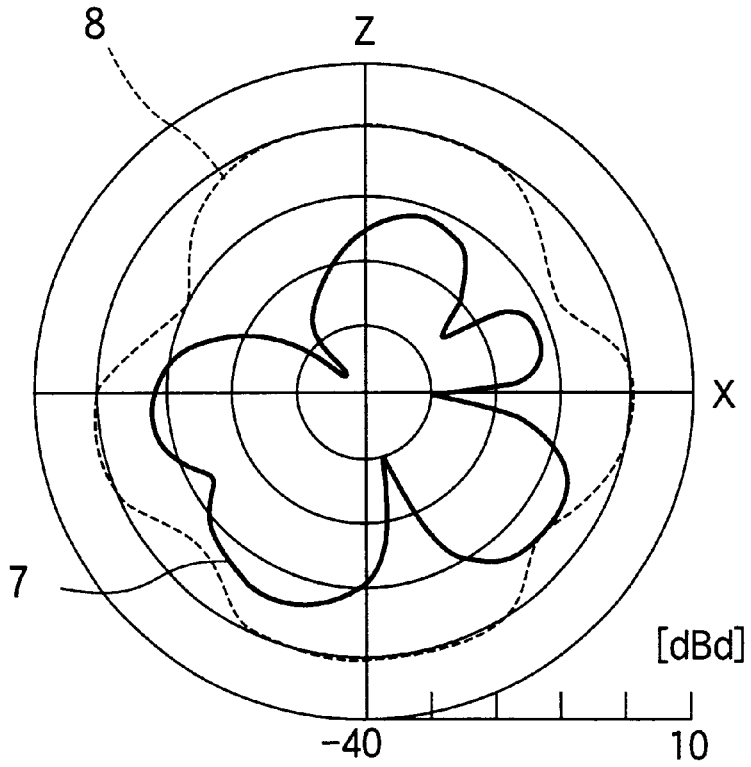
FIG. 2 is a diagram showing a directivity of the built-in antenna of FIGS. 1A, 1B, 1C, and 1D.

In the figures, reference numerals 1, 14 and 17 refer to monopole parts; 2, 10, 18 to a planar inverted-F antennae; 3, 11 and 31 to earthing parts; 4, 20, 32 and 34 to radiation efficiency feeding points; 5, 9, 15 and 26 to ground plates; 6 to a portable wireless unit; 7, 12, 35 and 37 to vertically polarized wave components; 8, 13, 36 and 38 to horizontally polarized wave components; 16 to a wireless information terminal; 19 to a feeding terminal; 21 to an earthing terminal; 22 to ground; 23 to a circuit board; 24 to a housing; 25 to a pawl made of resin; 28 to a monopole antenna; 29 to an insulating portion; 30 to a planar inverted-F antenna; and 33 to an radio frequency switch.

BEST MODE FOR CARRYING OUT THE INVENTION

Embodiments will now be described with reference to the accompanying drawings.

(First Embodiment)

FIGS. 1A to 1D are diagrams showing a construction of a built-in antenna which is a first embodiment of the present invention, when it is viewed from various directions. FIG. 1A is a front view when viewed from front, FIG. 1B is a bottom view when viewed from the lower side, and FIG. 1C is a side view when viewed from the side, and FIG. 1D is a development view showing only the antenna portion. In the figures, a monopole part 1 and a planar inverted-F antenna 2 are conductive plates which are constructed in an integral form, and the width of each of them is about 2 mm, and those parts are made of one and the same material. In FIG. 1D, the hatching is made different for merely distinguishing the monopole part 1 from the inverted-F antenna part. The antenna portion is disposed along the inside of a housing at the upper end of a portable wireless unit 6. Numerals representing the size of the housing are put on the vertical and horizontal sides. An operating frequency of the portable wireless unit using the element defined by those numerals is within a 1.9 GHz frequency band.

The length of the monopole part is selected to be about the half-wavelength (78 mm) of the operating frequency, and disposed along the inside of the housing at the upper part of the portable wireless unit 6. A distance "d" between the monopole part 1 and the ground plate 5 is set at about 2 mm.

The length of the inverted-F antenna part 2 is set at about ¼ wavelength (39 mm) of the operating frequency, and disposed parallel to the ground plate 5 while being spaced from the ground plate 5 by a distance "b" of 4 mm. The direction in which the inverted-F antenna part 2 is disposed is parallel to the upper end of the housing of the portable wireless unit 6 (Y-axis direction). The inverted-F antenna part 2 is connected at an earthing part 3 provided at one end thereof to a ground plate 5.

The antenna of the invention, as shown in the development view of FIG. 1D, is constructed such that at least one side of the integrally constructed conductive plate is bent downward at positions of crest folding parts 1*a* to 1*c*. The same thing is true for the crest folding part 2*a*. A feeding point 4 is provided at a position spaced a distance "s" (e.g., 5 mm) from the earthing part 3 of the inverted-F antenna part 2.

With such a construction, the monopole part 1 and the inverted-F antenna part 2 are operable as an integrally constructed composite antenna excited at the single feeding point 4.

Operation of the composite antenna will be described hereunder.

First consideration will be given to operation of the inverted-F antenna part 2 alone. The feeding point 4 of the inverted-F antenna part 2 is set at 50 Ω for impedance matching by adjusting the distance "s". Thereafter, when the monopole part 1 is connected to one end of the inverted-F antenna part 2, an impedance variation at the feeding point 4 is extremely small since the impedance values of both antenna parts are both high at a connection point of them. Actually, in design at the dimensions mentioned above, the impedance of the monopole part 1 is matched, at 50 Ω, to that of the inverted-F antenna part 2 by finely adjusting the distance "s" within a range of 1 mm. For this reason, the necessity is to additionally use no impedance matching circuit.

The inverted-F antenna part 2 may be considered to be a ¼ wavelength matching stub which is connected to the pole part 1 of the monopole antenna. And the inverted-F antenna part 2 per se serves also as a part of radiation element. Accordingly, a composition of the radiation characteristic of the monopole part 1 and that of the inverted-F antenna part 2 is presented.

The radiation characteristic of the antenna shown in FIG. 1 in a free space where no human body is present, will be described. FIG. 2 is a diagram showing a directivity of the antenna of the invention shown in FIGS. 1A to 1D in a vertical X-Z plane. A solid line 7 designates a vertically polarized wave component and a broken line 8 designates a horizontally polarized wave component. An average level of the horizontally polarized wave component of the directivity shown in FIG. 2 is higher than that of the vertically polarized wave component. In the directivity pattern, the X directions and the Z directions are the maximum radiation directions. The reason for this is that the wave radiation from both elements of the monopole part 1 and the inverted-F antenna part 2, which are disposed in the horizontal direction (Y direction) in FIGS. 1A to 1D, is dominant. From this, it is seen that the integrally constructed composite antenna shown in FIGS. 1A to 1D exhibits directivity patterns which are different from the conventional ones of the polarized wave components in the free space as shown in FIG. 12.

Figure 3A:
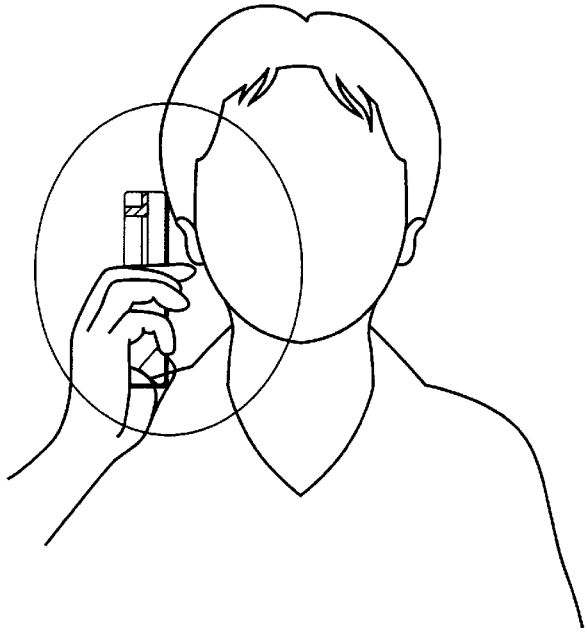
FIGS. 3A, 3B, and 3C are diagrams showing a speech communication state of the portable wireless unit.
Figure 3B:
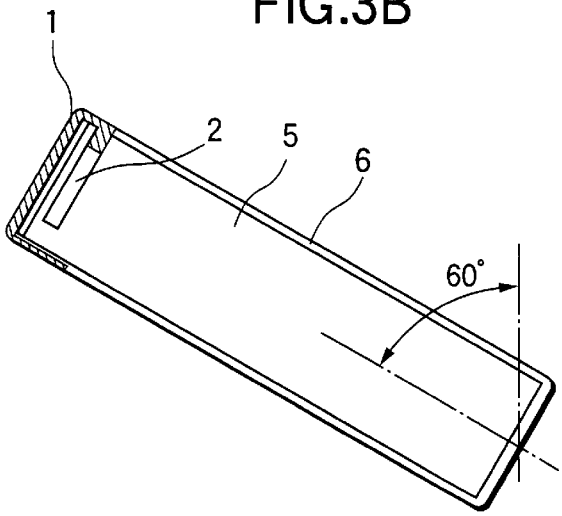
Figure 3C:
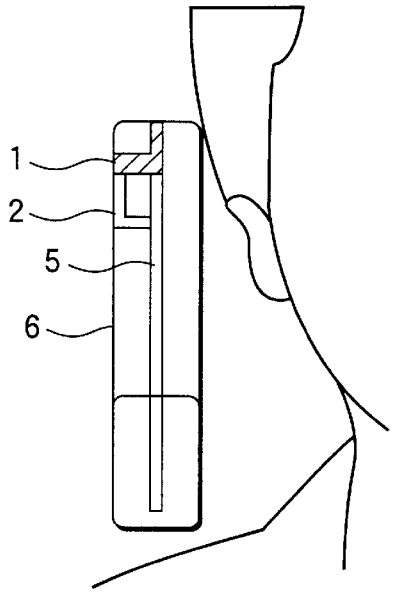
Figure 12:
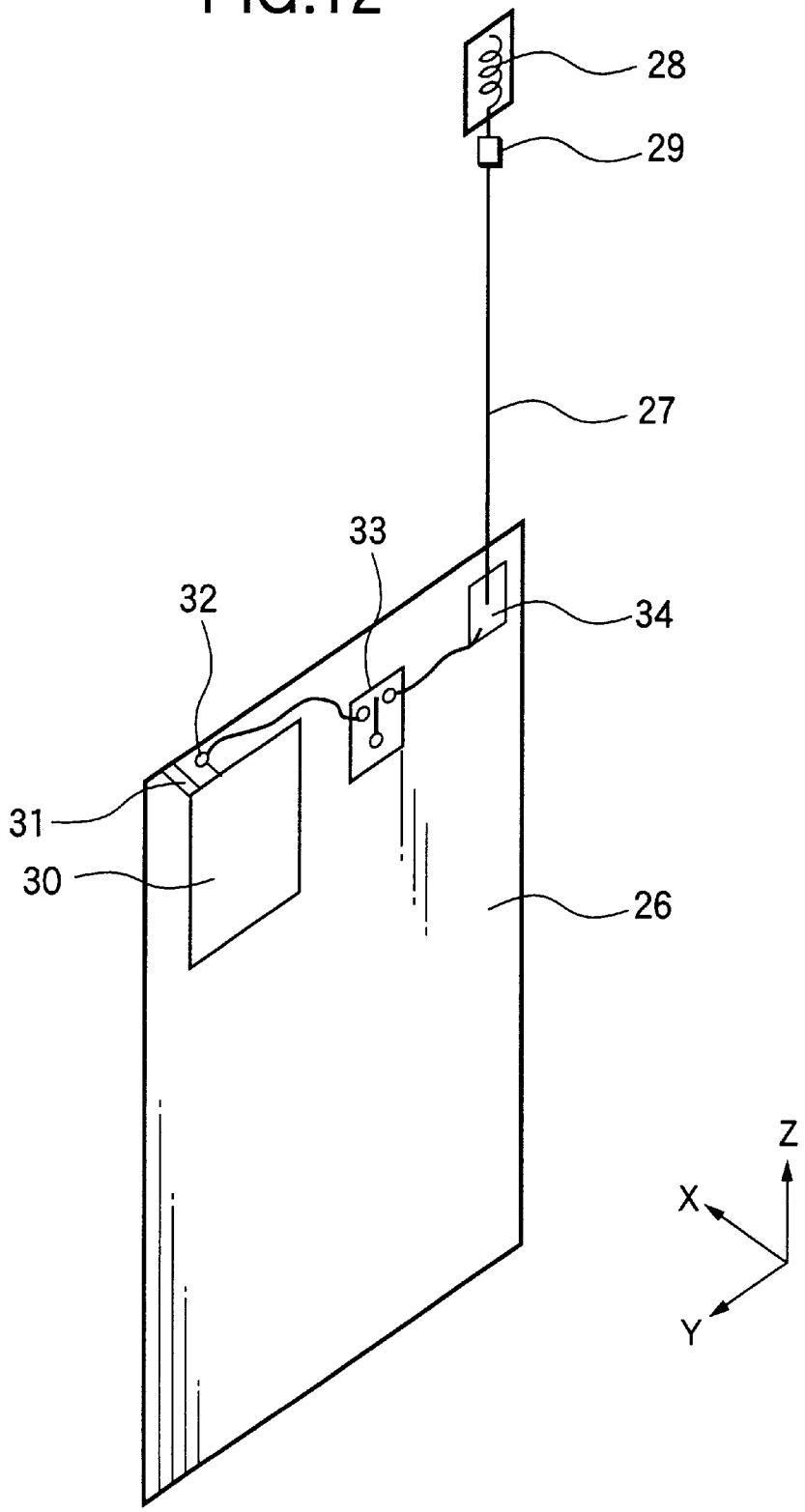
FIG. 12 is a diagram showing a basic construction of a conventional portable wireless unit.
Figure 13:
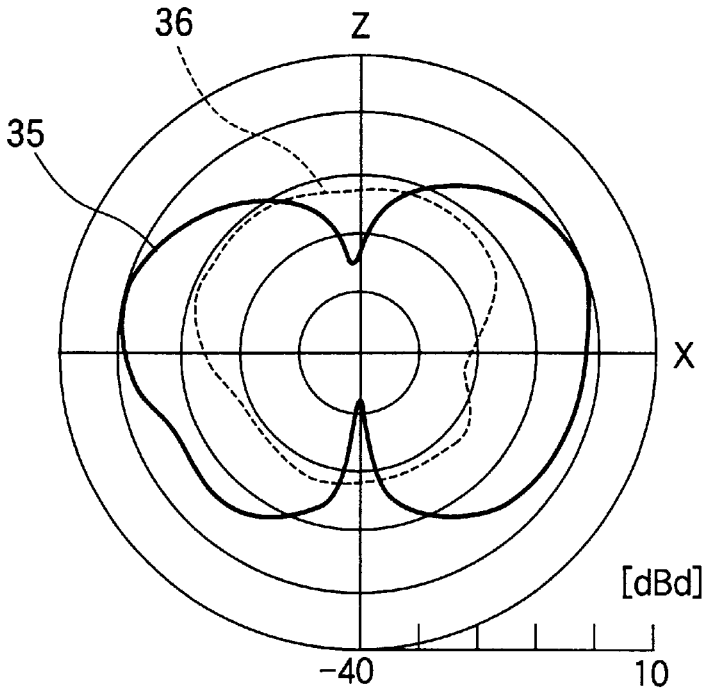
FIG. 13 is a diagram showing a directivity of a monopole antenna when it is selected FIG. 12.
Figure 14:
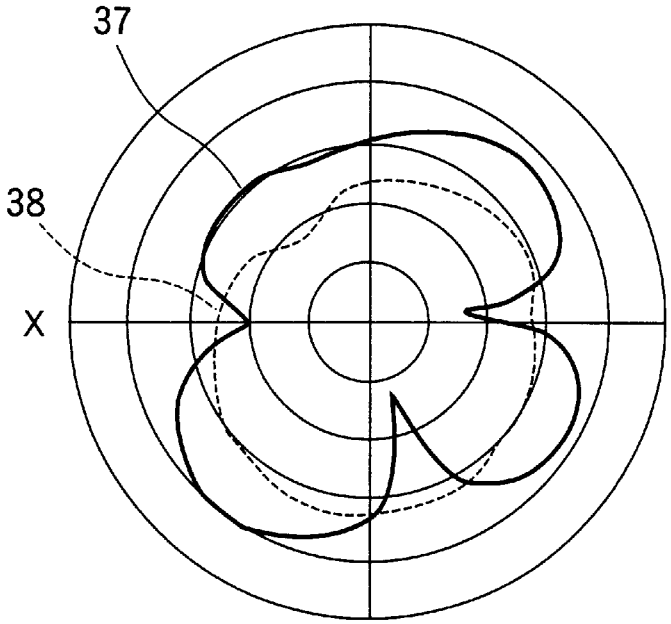
FIG. 14 is a diagram showing a directivity of a planar inverted-F antenna when it is selected in FIG. 12.

As a result, the speech communication state where the user holds the portable wireless unit by hand and moves it close to the ear is improved to have an advantageous effect, which is different from that by the conventional art. This will be discussed hereunder. In the speech communication state, it is frequent that the portable wireless unit is held in a state that it is slanted at about 60° with respect to the vertical direction, as shown in FIGS. 3A to 3C. FIG. 3A is a view showing the speech communication state when viewed from front; FIG. 3B is a side view showing the portable wireless unit at that time; and FIG. 3C is an enlarge view showing the speech communication state when viewed from front.

Where the monopole antenna 27 of the conventional portable wireless unit shown in FIG. 12 is used alone, the main polarized wave shown in FIG. 13 is directed in the axial direction of the monopole antenna 27. Accordingly, in the speech communication state as shown in FIGS. 3A to 3C, a wave component slanted at about 60° forms the main polarized wave. In this case, when the monopole antenna alone is considered, the horizontal plane pattern average gain PAG is about −7 dBd.

In the case of the planar inverted-F antenna 30 of the conventional portable wireless unit shown in FIG. 12, an antenna current distributes in the ground plate 26. Therefore, in the speech communication state as shown in FIGS. 3A to 3C, the deterioration of the radiation efficiency caused by the gripping it is great. As a result, the horizontal plane pattern average gain PAG is about −11 dB, low.

In the built-in antenna of the invention shown in FIGS. 1A to 1D, the antenna current distributes in both elements, i.e., the monopole part 1 and the inverted-F antenna part 2, and the current distributed in the ground plate 5 is small. Accordingly, the deterioration of the radiation efficiency caused by the gripping it is small. Further, as shown in FIG. 2, the main polarized wave is the horizontally polarized wave component. In the speech communication state as shown in FIGS. 3A to 3C, however, the vertically polarized wave component is high since the portable telephone is slanted at 60°. As a result, in the antenna of the invention shown in FIG. 1, the PAG is high, about −5 dB.

Figure 4:
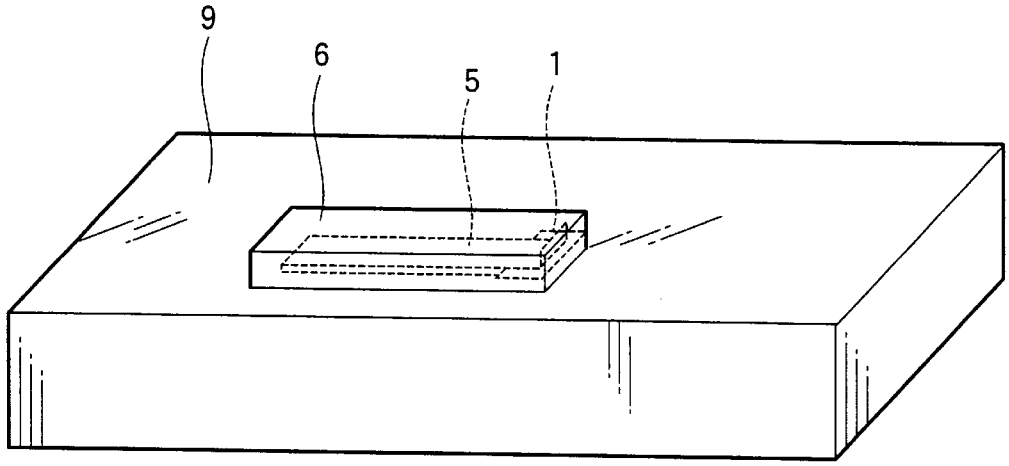
FIG. 4 is a diagram showing the portable wireless unit which is put on a metal table.

Operation of the antenna when the portable wireless unit is placed on the metal table 9 as shown in FIG. 4, will be described. Generally, in a stand-by state, it is frequent to place the portable wireless unit on the metal table 9, as shown in FIG. 4. In this case, in the case of the conventional art shown in FIG. 12, the whip antenna is frequently contained in the housing of the portable wireless unit, and the helical antenna 28 operates. In this case, the helical antenna 28 is close to the metal table 9 and its axial direction is parallel to the ground plate. Generally, the antenna gain is reduced by its electromagnetic interaction with the metal table 9. The PAG at this time is about −17 dB, low.

When the planar inverted-F antenna 30 shown in FIG. 12 is selected, the display of the portable wireless unit is generally located on the upper surface, and the planar inverted-F antenna 30 is close to the metal table 9 surface. Also in this case, the antenna gain is reduced, and the PAG is about −16 dBd, low.

In the built-in antenna of the invention shown in FIG. 1, the antenna current distributes in both the elements of the monopole part 1 and the inverted-F antenna part 2. Accordingly, also in a case where the inverted-F antenna part 2 side is placed close to the metal table 9, for example, the antenna current also distributes in the monopole part 1. The monopole part 1 is parallel to the ground plate 5 within the portable wireless unit 6, and is disposed at a position relatively close to the center with respect to the thickness of the housing of the portable wireless unit 6. Accordingly, it secures some space from the surface of the metal table 9, and the reduction of the gain is lessened. As a result, the PAG is about −13 dBd, and higher than that of the antenna of the conventional portable wireless unit.

One of the characteristic features of the built-in antenna of the invention resides in that the half-wavelength monopole part and the inverted-F antenna part are constructed in an integral form by using the single conductive element. With this feature, there is no need of using the impedance matching circuit, which is required for the case where the half-wavelength monopole antenna alone, and the construction of the portable wireless unit is simplified. Another characteristic feature of the invention resides in that the half-wavelength monopole part and the inverted-F antenna part are built in the portable wireless unit while being disposed parallel to the upper end of the portable wireless unit. With this feature, a high antenna gain is secured in a speech communication state and in a state that the portable wireless unit is placed on the metal table.

(Second Embodiment)

Figure 5A:
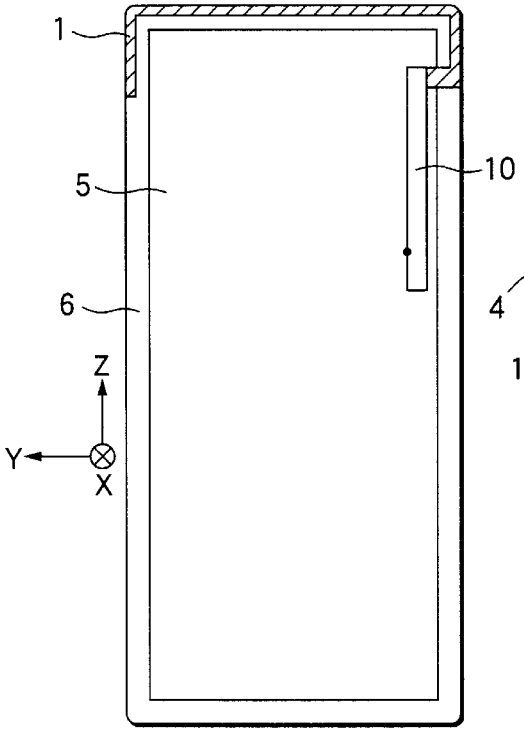
FIGS. 5A, 5B, 5C, and 5D are diagrams showing a basic construction of a built-in antenna which is a second embodiment of the present invention.
Figure 5C:
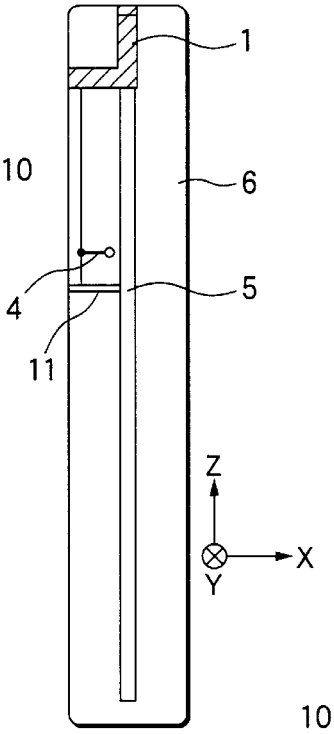
Figure 5D:
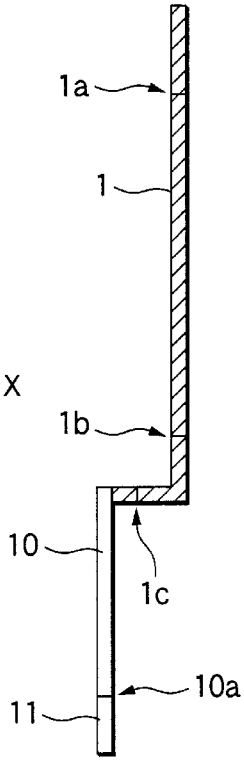
Figure 5B:
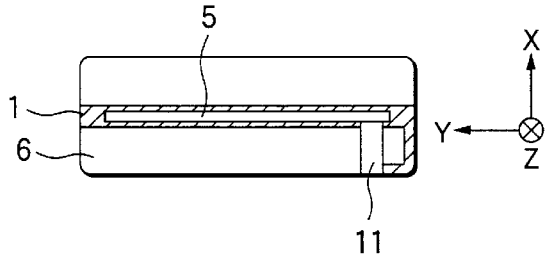

FIGS. 5A to 5D are diagrams showing a portable wireless unit containing an antenna of the invention, which is a second embodiment of the present invention. FIGS. 5A to 5C are diagrams as viewed from different directions, as in the FIGS. 1A to 1D case, and FIG. 5D is a development view showing only the antenna part. In FIGS. 5A to 5D, like or equivalent portions are designated by like reference numerals in FIGS. 1A to 1D.

In FIG. 5D, an inverted-F antenna part 10 and a monopole part 1 are conductive plates which are formed in an integral construction, and the width of each of them is about 2 mm, and those antenna parts are made of one and the same material. The length of the inverted-F antenna part 2 is set at about ¼ wavelength (39 mm) of the operating frequency, and disposed parallel to the ground plate 5, and is spaced from the ground plate 5 by a distance "h" (for example 4 mm). The direction in which the inverted-F antenna part 10 is disposed is parallel to the long side of the housing of the portable wireless unit 6 (Y-axis direction). The inverted-F antenna part 10 is connected at an earthing part 11 provided at one end thereof to a ground plate 5. A feeding point 4 is provided at a position spaced a distance "S" (e.g., 5 mm) from the earthing part 11 of the inverted-F antenna part 10. Crest folding parts 1*a* to 1*c* in FIG. 5D are bent as it is to form the antenna part.

With such a construction, the monopole part 1 and the inverted-F antenna part 10 are operable as an integrally constructed composite antenna excited at the single feeding point 4.

Operation of this antenna will be described hereunder.

First consideration will be given to operation of the inverted-F antenna part 10 shown in FIGS. 5A to 5D. The inverted-F antenna part 10 may be considered to be a ¼ wavelength matching stub which is connected to the monopole part 1. And the inverted-F antenna part 2 per se serves also as a part of radiation element. In this instance, the inverted-F antenna part 10 is disposed in the vertical direction (Z direction) in the coordinate system of FIG. 5, and for its radiation, the vertically polarized wave component serves as a main polarized wave. As for the radiation characteristic of the antenna in the embodiment shown in FIGS. 5A to 5D, the vertically polarized wave component is somewhat higher than that in the directivity shown in FIGS. 1A to 1D (FIG. 2).

Figure 6:
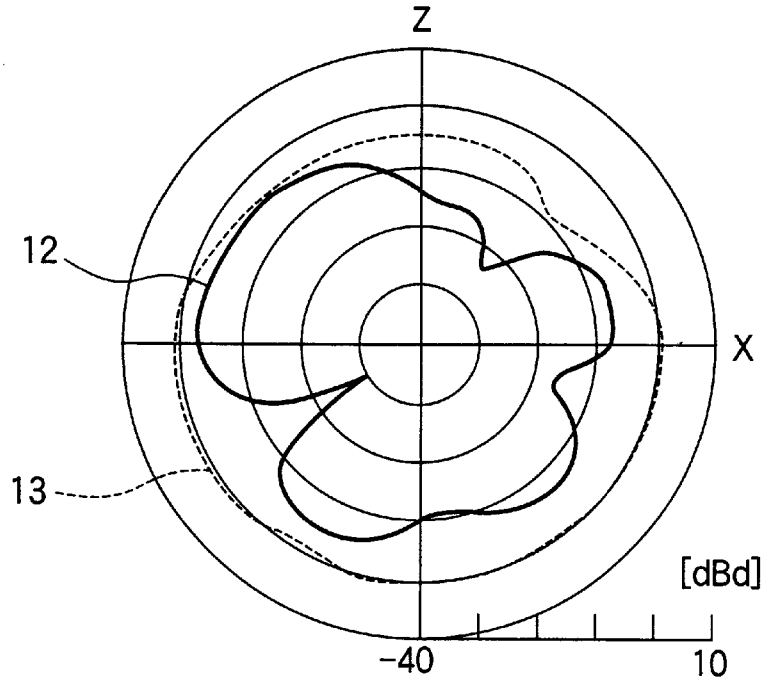
FIG. 6 is a diagram showing a directivity of the built-in antenna of FIGS. 5A, 5B, 5C, and 5D.

FIG. 6 is a diagram showing a directivity of the antenna of FIG. 5 in the vertical X Z plane. In FIG. 6, a solid line 12 designates a vertically polarized wave component and a broken line 13 designates a horizontally polarized wave component. When comparing the FIG. 6 directivity with the FIG. 2 one, the average level of the horizontally polarized wave component is somewhat lower than that of the comparing case, but the average level of the vertically polarized wave component is higher than the latter by about 3 dB. For the directivity of the vertically polarized wave component, the radiation is high in the +X and −X directions.

Figure 7:
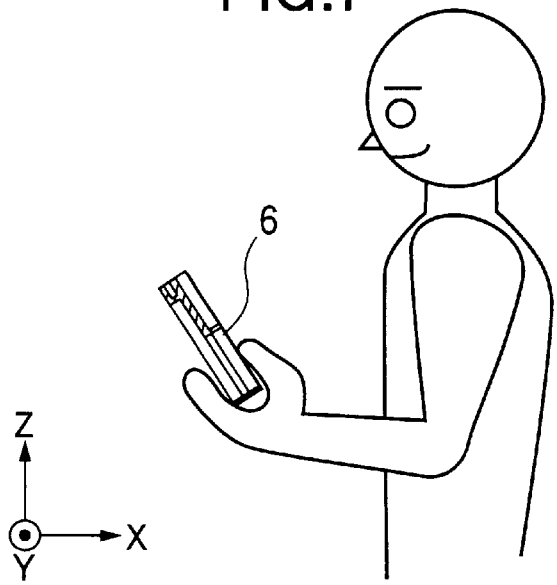
FIG. 7 is a diagram showing a state that the portable wireless unit is gripped.

The present portable wireless unit is actively used for i-mode basis information gathering and e-mail basis communication. The moving image distribution together with voice speech, and the video telephone service have started. In such an information communication, it is frequent that, as shown in FIG. 7, the user grips the portable wireless unit and holds it in front of his chest, and in this state, he operates it (hand-holding operation state). Accordingly, the portable wireless unit 6 is used in a raised state. To increase the PAG of it, it is necessary to increase the vertically polarized wave component when the portable wireless unit is raised. In the second embodiment of the invention, the inverted-F antenna part 10 is disposed in the vertical direction (Z direction). As a result, the average level of the vertically polarized wave component is increased by about 3 dB. Further, in the directivity shown in FIG. 6, the vertically polarized wave component is radiated more intensively in the −X direction. As a result, when the antenna shown in FIGS. 5A to 5D is used in the hand-holding operation state shown in FIG. 7, the PAG higher by about −6.0 dBd is obtained.

In the speech communication state shown in FIGS. 3A to 3C, the effects comparable with those of the first embodiment are obtained, and hence the vertically polarized wave component is high in level. However, the horizontally polarized wave component in the free space is somewhat reduced. The PAG in this case is lower than that of the FIGS. 1A to 1D antenna by 0.5 dB, i.e., about −5.5 dBd.

When the portable wireless unit 6 is placed on the metal table 9 shown in FIG. 4, the PAG is high, comparable with that of the antenna of the first embodiment since the effects of the instant embodiment are comparable with those of the first embodiment.

As described above, one of characteristic features of the antenna of the instant embodiment resides in that the half-wavelength monopole part and the inverted-F antenna part are constructed in an integral form by using the single conductive element. With this feature, there is no need of using the impedance matching circuit which is required for the case of the half-wavelength monopole alone, and the construction of the portable wireless unit is simplified.

Another characteristic feature of the invention resides in that the half-wavelength monopole part is built in the portable wireless unit while being disposed parallel to the upper end of the portable wireless unit, and the inverted-F antenna part is built in while being disposed parallel to the long side of the portable wireless unit. With this feature, a high antenna gain is secured in the hand-holding operation state and speech communication state, and in a state that the portable wireless unit is placed on the metal table.

(Third Embodiment)

Figure 8A:
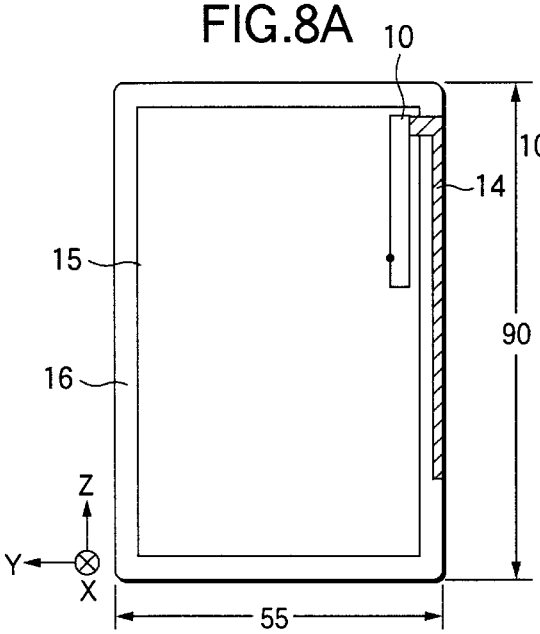
FIGS. 8A, 8B, 8C, and 8D is a diagram showing a basic construction of a built-in antenna which is a third embodiment of the present invention.
Figure 8C:
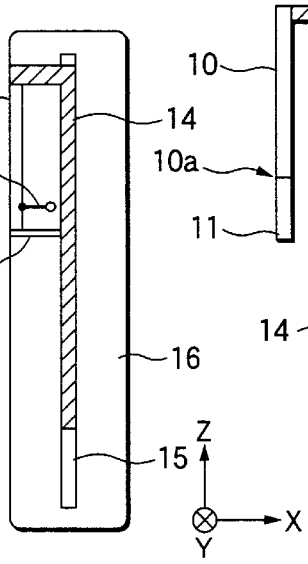
Figure 8D:
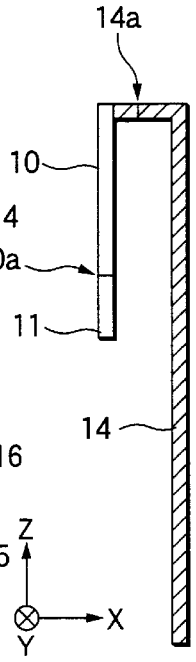
Figure 8B:
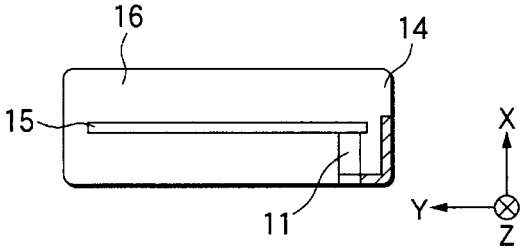

FIGS. 8A to 8D are diagrams showing a third embodiment of the built-in antenna for the portable wireless unit according to the invention. FIGS. 8A to 8C are diagrams when the embodiment is viewed from different directions, as in the FIGS. 1A to 1D case. FIG. 8D is a development view showing only the antenna portion. In FIGS. 8A to 8D, like or equivalent portions are designated by like reference numerals used in FIGS. 1A to 1D. The portable wireless unit of the embodiment is designed on the assumption that the user does not use the wireless unit for speech communication in a state that the wireless unit is held close to user's ear, but he receives music distribution services, for example. Accordingly, in the description of the embodiment, the portable wireless unit will be handles as an information wireless terminal.

A planar inverted-F antenna part 10 and a monopole part 14 shown in FIGS. 8A to 8D, are conductive plates whose width is e.g., 2 mm, and are formed in an integral construction as shown in FIG. 8D. The length of the monopole part 14 is selected to be about the half wavelength (78 mm) of the operating frequency, and is disposed along the long side of a wireless information terminal 16 and inside of the housing the information wireless unit. The direction in which the planar inverted-F antenna part 10 is disposed is parallel to the long side of the information wireless unit 16 (Z-axis direction). A distance between the long side of a ground plate 15 and the monopole part 14 is set at about 2 mm. Crest folding parts 10*a* and 14*a* in FIG. 8D are bent as it is to form the antenna part.

With such a construction, the monopole part 14 and the inverted-F antenna part 10 are operable as an integrally constructed composite antenna excited at the single feeding point 4.

Operation of the composite antenna will be described hereunder.

In the antennae mounted in the information wireless unit 16, the monopole part 14 and the planar inverted-F antenna part 10 are both disposed in the vertical direction (Z-axis direction). Therefore, an average level of the vertically polarized wave component is high, and the radiation in the horizontal plane (X Y plane) direction is large.

Figure 9:
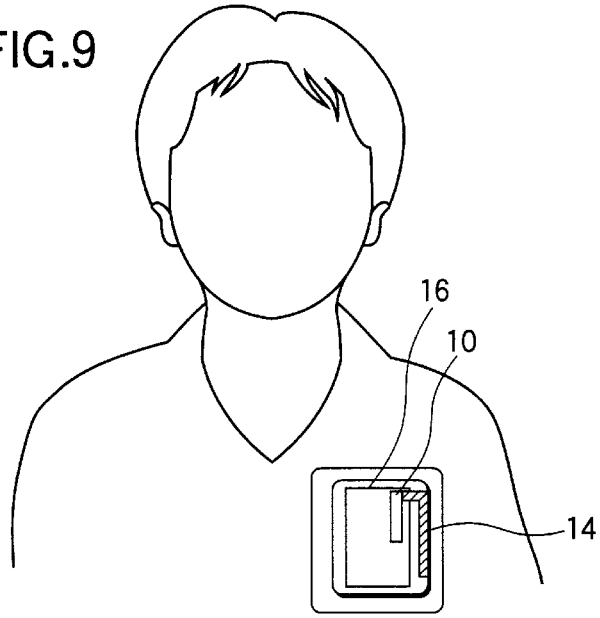
FIG. 9 is a diagram showing a stand-by state of the portable wireless unit which is put in the chest pocket.

The information wireless unit 16 is frequently put in a state that it is put in a user's chest pocket, as shown in FIG. 9, or a state that it is operated gripped by a user, as shown in FIG. 7. In a case where the information wireless unit 16 is put in a user's chest pocket, the orientation of the information wireless unit 16 is not fixed. Accordingly, to obtain a high PAG, it is necessary to increase the vertically polarized wave component even if the information wireless unit 16 is directed in any direction.

If a planar inverted-F antenna 30 shown in FIG. 12 is mounted on one of the sides of the information wireless unit 16, there is the possibility that the planar inverted-F antenna 30 is directed to the human body. In this case, the reduction of the radiation efficiency is great, and the PAG is about −10 dBd, and low. If a whip antenna shown in FIG. 12 is mounted in the information wireless unit 16, the whip antenna is frequently stored therein, and the helical antenna 28 operates. In this case, the reduction of the radiation efficiency is great, and the PAG is about −8 dBd, low.

In the antenna of the invention shown in FIGS. 8A to 8D, the antenna current distributes in both the elements of the monopole part 14 and the inverted-F antenna part 10.

Accordingly, also in a case where the inverted-F antenna part 2 side is located close to a human body, for example, the antenna current also distributes in the monopole part 14. Further, since the both elements of the monopole part 14 and the planar inverted-F antenna part 10 are disposed in the vertical direction (Z-axis direction), an average level of the vertically polarized wave component is high. Accordingly, the PAG in an in-chest-pocket state shown in FIG. 9 is high. Even if the face of the information wireless unit 16 is directed to the human body in the X or −X direction in the coordinate system of FIGS. 8A to 8D, the PAG in-chest-pocket state is about −6 dBd.

In the hand-hold operation state shown in FIG. 7, both the elements of the monopole part 14 and the planar inverted-F antenna part 10 are disposed in the vertical direction (Z-axis direction). Accordingly, the average level of the vertically polarized wave component is increased. The antenna current is distributed in both the monopole part 14 and the planar inverted-F antenna part 10. Therefore, the current distributed in the ground plate 15 is small, and the reduction of the radiation efficiency caused by the gripping of the wireless unit is small. Accordingly, the PAG is high, and as a result, it is about −6 dBd.

In the case where the information wireless unit 16 is placed on the metal table shown in FIG. 4, the effects comparable with the built-in antenna of the first embodiment are obtained, and hence the high PAG comparable with those of the first embodiment is obtained.

As described above, one of characteristic features of the instant embodiment resides in that there is no need of using a matching circuit, and the construction of the information wireless unit is simplified. Another characteristic feature of the invention resides in that the half-wavelength monopole part and the planar inverted-F antenna part are built in the information wireless unit while being disposed parallel to the long side of the information wireless unit. With this feature, a high antenna gain is secured in the in-chest-pocket state, the hand-holding operation state and in the state that the information wireless unit is placed on the metal table.

(Fourth Embodiment)

Figure 10A:
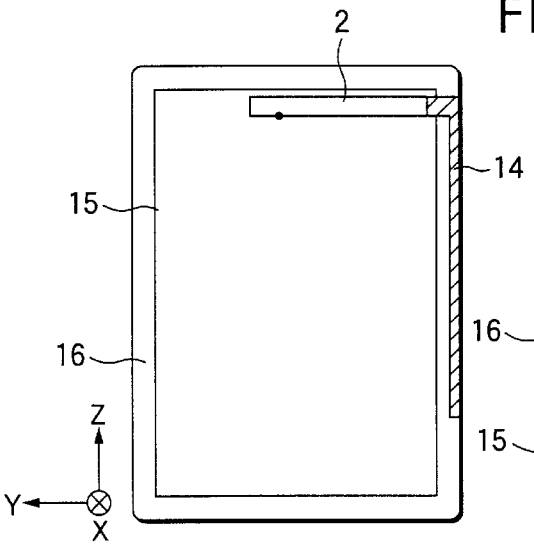
FIGS. 10A, 10B, 10C, and 10D are diagrams showing a basic construction of a built-in antenna which is a fourth embodiment of the present invention.
Figure 10C:
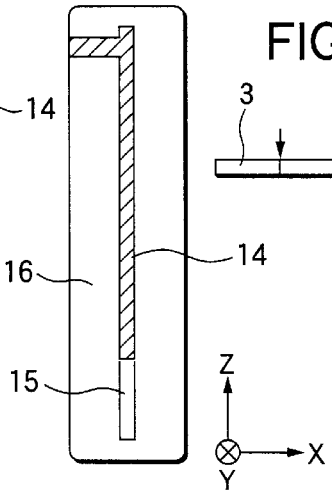
Figure 10D:
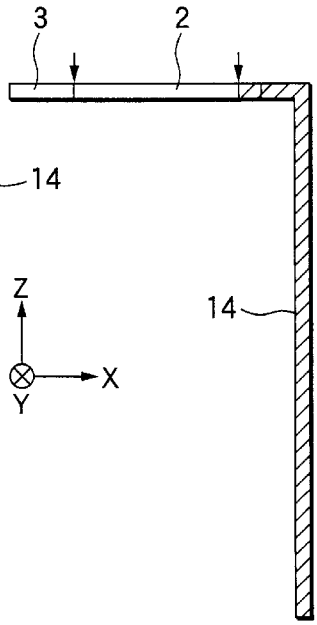
Figure 10B:
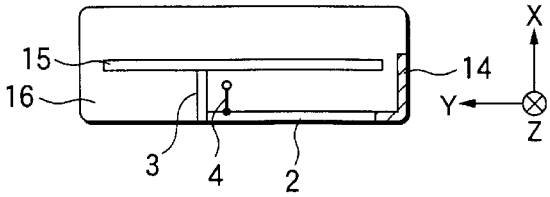

FIGS. 10A, 10B, 10C, and 10D are diagrams showing a construction of an antenna which is a fourth embodiment of the present invention. FIGS. 10A to 10C are diagrams as viewed from different directions, as in the FIGS. 1A to 1D case, and FIG. 10D is a development view showing only the antenna part. In FIGS. 10A to 10D, like or equivalent portions are designated by like reference numerals in FIGS. 1A to 1D and 8A to 8D. A device used in the embodiment is an information wireless terminal.

In FIGS. 10A to 10D, the inverted-F antenna part 2 and the monopole part 14 are conductive plates which are formed in an integral construction as shown in the development view of FIG. 10D, and the width of each of them is about 2 mm. The direction in which the inverted-F antenna part 2 is disposed is parallel to the upper end of the information wireless unit 16 (Y-axis direction).

With such a construction, the monopole part 14 and the inverted-F antenna part 2 are operable as an integrally constructed composite antenna excited at the single feeding point 4.

Operation of the composite antenna will be described.

First consideration will be given to operation of the inverted-F antenna part 2 shown in FIGS. 10A to 10D. The inverted-F antenna part 2 is disposed in the vertical direction (Z direction) in the coordinate system of FIGS. 10A to 10D, and for its radiation, the vertically polarized wave component serves as a main polarized wave. As for the radiation characteristic of the antenna in the fourth embodiment shown in FIGS. 5A to 5D, an average level of the vertically polarized wave component is somewhat lowered, but an average level of the horizontally polarized wave component is increased by about 3 dB, when comparing to the directivity of the radiation characteristics of the antenna shown in FIGS. 8A to 8D.

There is a chance that when the antenna shown in FIGS. 10A to 10D is put in a user's chest pocket, as shown in FIG. 9, a state possibly occurs that the long side of the information wireless unit 16 is put at the bottom of the pocket. In this case, the inverted-F antenna part 2 is disposed in the horizontal direction (Y direction) in the coordinate system of FIG. 10. Therefore, the vertically polarized wave component is increased by the radiation of the inverted-F antenna part 2. As a result, the PAG of the antenna is improved by about 3 dB when comparing to that of the built-in antenna shown in FIG. 8. In a case where the inverted-F antenna part 2 is directed to a human body, the PAG is improved by about 1 dB.

In the case where the information wireless terminal is put in a chest pocket as shown in FIG. 9, when the short side of the information wireless unit 16 is put at the bottom of the pocket, the effects comparable with those of the built-in antenna of the third embodiment of the invention, are obtained, and hence the vertically polarized wave component is increased. However, the vertically polarized wave component in the free space is somewhat reduced. The PAG in this case is lower than that of the FIGS. 8A to 8D built-in antenna by 0.5 dB, i.e., about −6.5 dBd.

In the hand-holding operation state shown in FIG. 7, the effects comparable with those of the built-in antenna of the third embodiment, are obtained, and the PAG is increased. As a result, the PAG is about −7 dBd.

When the information wireless unit is placed on the metal table shown in FIG. 4, the PAG is high, comparable with that of the built-in antenna of the first embodiment since the effects of the instant embodiment are comparable with those of the first embodiment.

As described above, one of characteristic features of the built-in antenna of the instant embodiment resides in that the half-wavelength monopole part and the inverted-F antenna part are constructed in an integral form by using the single conductive element. With this feature, there is no need of using the impedance matching, and the construction of the information wireless unit is simplified.

Another characteristic feature of the invention resides in that the half-wavelength monopole part is built in the information wireless unit while being disposed parallel to the long side of the information wireless unit, and the inverted-F antenna part is built in while being disposed parallel to the upper end of the information wireless unit. With this feature, a high antenna gain is secured in a state that the information wireless unit is put in a chest pocket in a desired direction and the hand-holding operation state, and in a state that the information wireless unit is placed on the metal table.

(Fifth Embodiment)

Figure 11B:
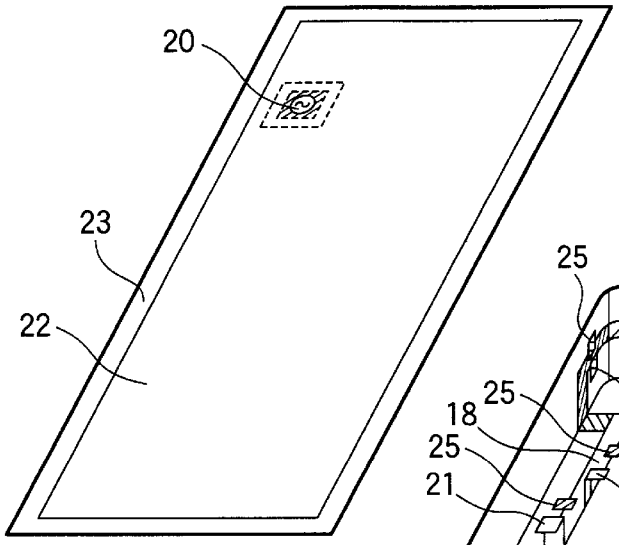
FIGS. 11A, 11B, 11C, and 11D are diagrams showing a basic construction of a built-in antenna which is a fifth embodiment of the present invention.
Figure 11C:
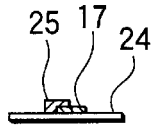
Figure 11A:
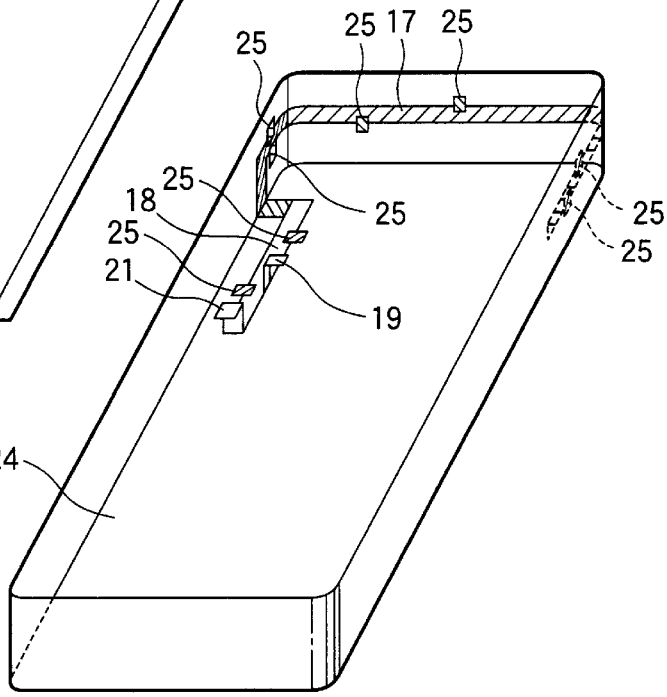
Figure 11D:
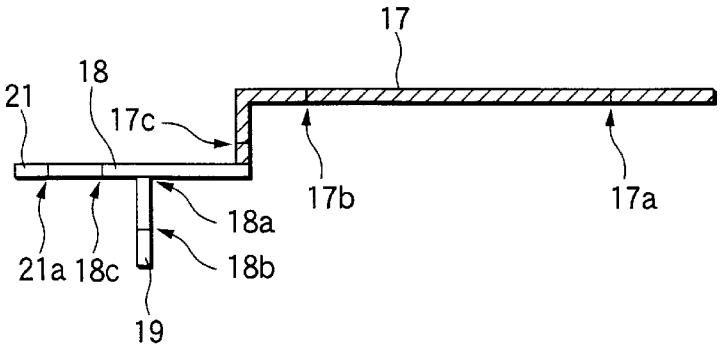

FIGS. 11A to 11D is a diagram showing an antenna which is a fifth embodiment of the present invention. In FIGS. 11A to 11D, FIG. 11A shows a state that a composite antenna to be described later is fixed to the inside of a housing 24. FIG. 11B shows a state that a circuit board 23 and a ground 22 are removed from the housing 24. FIG. 11C shows a state that a monopole part 17 of the antenna is mounted on the housing 24. FIG. 11D is a development view showing an antenna element.

In FIG. 11D, the developed antenna is formed with a conductive member of, for example, 2 mm in width. At least one side of the conductive plate is bent upward at parts indicated as trough folding parts 17*a*, 17*b* and 17*c*. The same thing is correspondingly applied to trough folding parts 18*a*, 18*b* and 18*c*, and it is bent downward at a crest folding part 21*a*. The antenna structure thus bent forms the monopole part 17 and the inverted-F antenna part 18, and fixed to the housing 24. To fix the antenna, pawls 25 made of resin are used. As shown in FIG. 11C, the lower sides of the pawls 25 are fixed to the housing 24, and the antenna parts are fixed thereto with the cutout parts of the pawls 25.

An earthing terminal 21 is provided at a position on the opposite side of the monopole of the inverted-F antenna part 18. The earthing terminal 21 comes in contact with a ground plate 22 provided at a part on the circuit board 23. A feeding terminal 19, which comes in contact with a feeding point 20 on the circuit board 23, is provided at a position spaced apart from the earthing terminal 21 by a distance "s" (for example, 5 mm).

The monopole part 17 and the inverted-F antenna part 18 are integrally constructed into a composite antenna, and the composite antenna is fixed to the inside of the housing 24. Therefore, the effects of the composite antenna are comparable with those of FIG. 5 case. Communication is possible in a manner that after the composite antenna is fixed to the inside of the housing, the circuit board 23 is inserted into the housing 24. Accordingly, the assembling work is easy, and the production process is simplified.

(Other Embodiments)

In the embodiment, the length of the monopole part is the half-wavelength, but it may be any length if it allows the monopole part to be impedance matched to the inverted-F antenna part.

While in the embodiments mentioned above, the inverted-F antenna part is the ¼ wavelength, it may be any length if it allows the inverted-F antenna part to be impedance matched to the monopole part.

Even if the inverted-F antenna part is a planar inverted-F antenna or a half-wavelength MSA, the monopole part 1 is connected to a point of it where impedance is high, and those are coupled into an integral construction.

In the fifth embodiment, the resin pawls are used for fixing the built-in antenna to the housing. If required, a double-faced tape is stuck to the built-in antenna, and then the antenna is fixed to the housing 24. Adhesive or resin, which is molten at high temperature, may be used for fixing the built-in antenna to the housing.

While the present invention has been described using specific embodiments, it will readily be understood that the invention may variously be modified, altered and changed within the true spirits and scope of the invention.

This application is based on Japanese Patent Application No. 2001-008008, filed Jan. 16, 2001, the content of which is incorporated herein by reference.

INDUSTRIAL APPLICABILITY

A built-in antenna for a portable wireless unit, which is constructed according to the present invention, is thus constructed. Therefore, the built-in antenna retains a high radiation characteristic in various states, for example, when the portable wireless unit is made close to the ear of the user in a speech communication state, when the use grips the portable wireless unit and in this state he operates for speech, and when the portable wireless unit is put on the metal table.

What is claimed is:

1. A built-in antenna for a portable wireless unit comprising:

a conductive antenna element disposed along the inside of a housing at an upper end of a portable wireless unit, the conductive antenna including:

a monopole part defined as a part of a length of a substantially half-wavelength of the conductive antenna;

an inverted-F antenna part defined as the remaining part of a length of a substantially ¼ wavelength of the conductive antenna; and an antenna feeding point provided at a position near an earthing part of the inverted-F antenna part;

wherein the inverted-F antenna part is disposed parallel to a ground plate surface within the housing of the portable wireless unit and parallel to the upper end of the portable wireless unit and one end of the inverted-F antenna part is connected to the ground plate as the earthing part.

2. A built-in antenna for a portable wireless unit according to claim 1, wherein the inverted-F antenna part is disposed along the long side of the portable wireless unit.

3. A built-in antenna for a portable wireless comprising:

a conductive antenna element disposed along the long side of the inside of a housing, the conductive antenna element including:

a monopole part defined as a part of a length of a substantially half-wavelength of the conductive antenna element;

an inverted-F antenna part defined as the remaining part of a length of a substantially ¼ wavelength of the conductive antenna element; and an antenna feeding point provided at a position near an earthing part;

wherein one end of the inverted-F antenna part is connected, to the ground plate as an earthing part, and the inverted-F antenna part is disposed parallel to the ground plate of the housing of the portable wireless unit and along the long side of the inside of the housing.

4. A built-in antenna for a portable wireless unit according to claim 3, wherein the inverted-F antenna part is disposed parallel to the ground plate of the housing of the portable wireless unit, and parallel to the upper end of the inside of the housing.

5. A built-in antenna for a portable wireless unit according to any of claims 1 to 4, further comprising:

fixing means for fixing the antenna element to the rear side of the housing; and contacting means for making the earthing part and the feeding point of the antenna element contact with a printing pattern on a circuit board.

* * * * *